United States Patent [19]

Nava

[11] Patent Number: 4,575,122

[45] Date of Patent: Mar. 11, 1986

[54] COVER STRUCTURE FOR BOOKS, DIARY BOOKS, AND THE LIKE

[75] Inventor: Rinaldo Nava, Milan, Italy

[73] Assignee: Nava Milano S.p.A., Milan, Italy

[21] Appl. No.: 570,555

[22] Filed: Jan. 13, 1984

[30] Foreign Application Priority Data

Jan. 21, 1983 [IT] Italy ..... 20571/83[U]

[51] Int. Cl.[4] ..... B42D 3/06; B42D 3/08

[52] U.S. Cl. ..... 281/29; 412/17

[58] Field of Search ..... 281/29, 1, 15 R; 412/3, 412/17, 1, 9, 19

[56] References Cited

U.S. PATENT DOCUMENTS

| | | | |
|---|---|---|---|
| 3,199,896 | 8/1965 | Caddoo | 412/17 X |
| 3,201,145 | 8/1965 | Libby | 281/29 X |
| 3,204,986 | 9/1965 | Tooker | 412/17 X |
| 3,972,764 | 8/1976 | Sendor | 412/17 X |
| 4,405,156 | 9/1983 | Carter et al. | 412/3 X |

*Primary Examiner*—Paul A. Bell

*Attorney, Agent, or Firm*—Guido Modiano; Albart Josif

[57] ABSTRACT

The cover comprises, in a single body of a plastics material, two substantially rigid cover panels held together by a flexible spine whereto the spine edge of the stack of sheets forming the book, diary book or the like is connected by glueing.

1 Claim, 6 Drawing Figures

Fig. 1
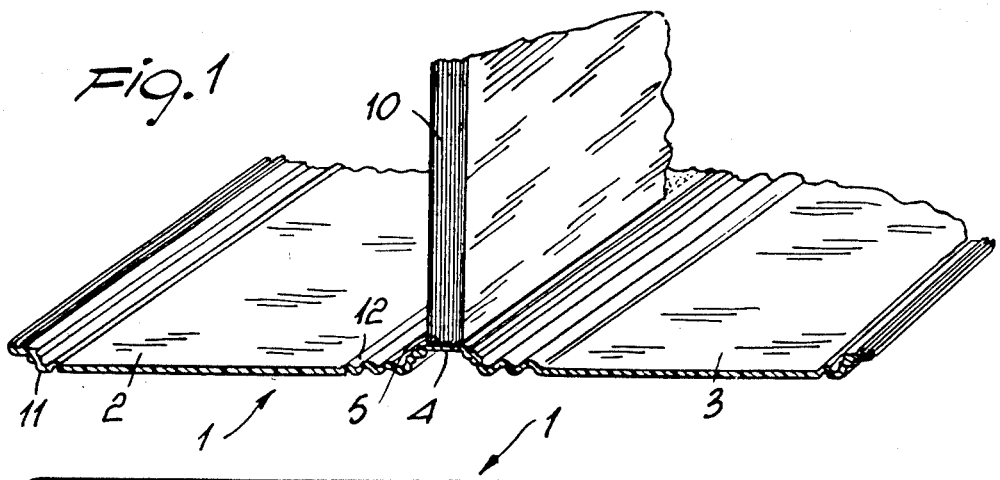
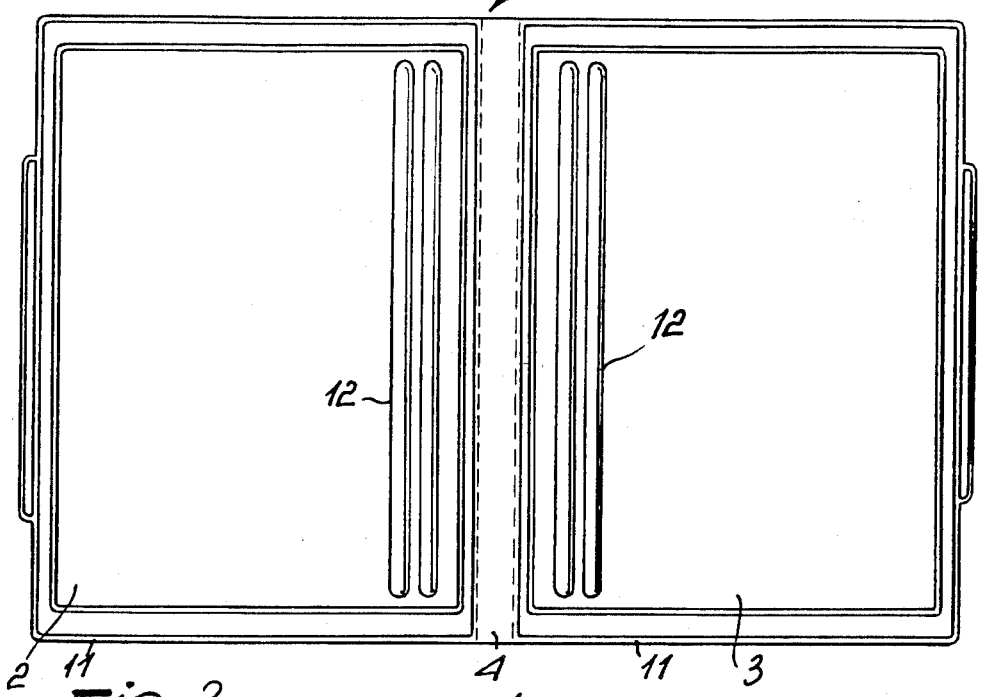
Fig. 2
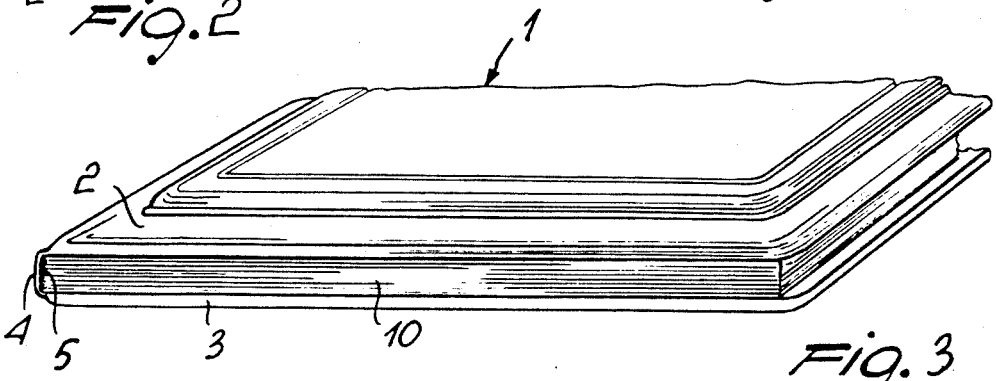
Fig. 3

Fig. 4
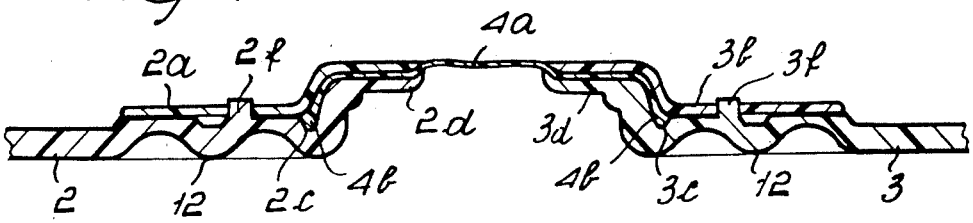
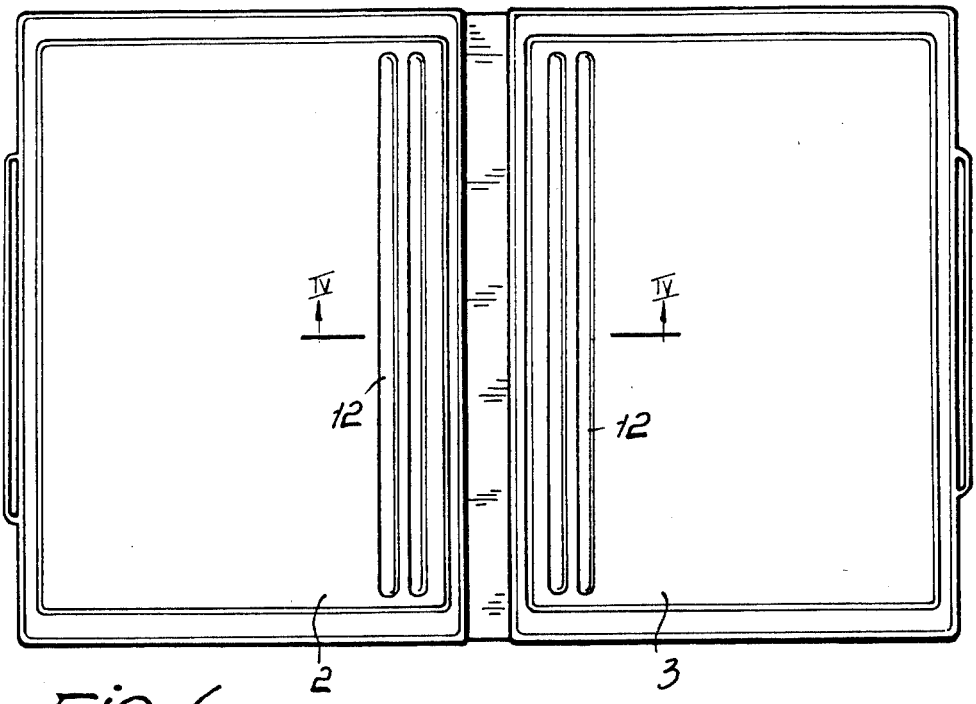
Fig. 6
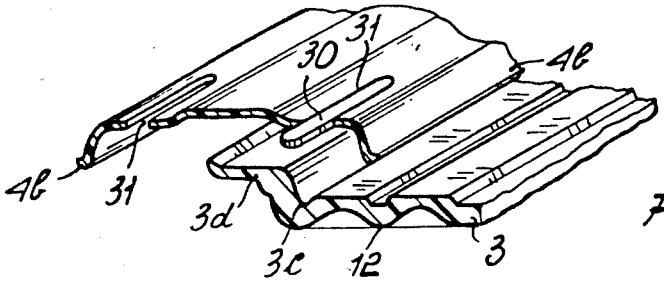
Fig. 5

COVER STRUCTURE FOR BOOKS, DIARY BOOKS, AND THE LIKE

BACKGROUND OF THE INVENTION

This invention relates to a cover structure for books, diary books, and the like.

As is known, for binding books and the like, covers are currently utilized which, in their most common configuration, comprise two cardboard panels or substantially flat rigid elements spanning the book front and back portions. The cardboard panels, which are lined externally with hide, paper, cloth, and the like materials, are held together by a spine which affords a degree of pliability for opening the book and the like.

The stack of sheets or pamphlets sewn together are generally joined to the cover by means of a sheet spine reinforcing gauze which is glued only to the inside faces of the covers and possibly covered with a sheet of paper or the like to enhance their appearance.

According to another book-binding technique, commonly termed brochure, a cover is used which is formed from a relatively lightweight sheet material to provide integrally formed front and rear covers, and spine, the spine of the covers being glued directly on the back of the sheet stack or pamphlets to provide in practice a flexible element acting as a hinge for opening and closing the book or the like.

From the above review of the prior art, it may be noted that the first-mentioned approach affords the possibility of providing rigid covers, but not of glueing the sheet spine or back directly to the cover spine, thereby after a certain time period there may occur breakage at the area of attachment of the cover to the sheet stack or pamphlets.

With the second-mentioned approach this danger is eliminated because the back of the sheet stack is glued directly to the cover spine, thus providing a stable connection, but with the disadvantage that the covers must of necessity be formed from a pliable material, since they are formed by the same sheet which forms the spine, which is to remain pliable to permit the book or the like to be opened and closed.

SUMMARY OF THE INVENTION

It is an object of this invention to overcome the above problems by providing a novel type of cover which can combine the cited advantages of both such prior techniques, while obviating their disadvantages.

It is another object of the invention to provide a cover structure which is specially designed for books, diary books, and the like and affords the possibility of obtaining in a much simplified fashion highly valuable products from both the constructional and aesthetic standpoints.

A further object of this invention is to provide a cover structure for books, diary books, and the like, which on account of its peculiar constructional features can give full assurance of being safe and reliable in use.

According to one aspect of the invention, these and other objects, such as will be apparent hereinafter, are achieved by a cover structure for books, diary books, and the like, comprising two substantially rigid covers united together by a substantially flexible outside spine, the inside face of said outside spine being directly attachable as by glueing to the inside spine edge or back of the sheet stack or pamphlets forming the book, diary book, or the like, characterized in that said flexible outside spine has connection portions integral therewith and with said rigid covers thereby rendering said flexible outside spine an integral part of said rigid covers.

BRIEF DESCRIPTION OF THE DRAWINGS

Further features and advantages will be more readily understood from the following detailed description of a cover structure for books, diary books, and the like, as illustrated by way of example and not of limitation in the accompanying drawing, where:

FIG. 1 shows schematically a cross-sectional view of the cover, according to this invention, in its open condition and as applied on a sheet or pamphlet stack;

FIG. 2 shows the cover in its stretched condition as viewed from the inside;

FIG. 3 is a sectional detail view of the cover as applied on a stack of sheets and in its closed position;

FIG. 4 is a cross-sectional view on line IV—IV of FIG. 6;

FIG. 5 is an exploded view of some component parts of FIG. 4; and

FIG. 6 is a plan view of the inside of a modified embodiment of the invention.

DESCRIPTION OF THE PREFERRED EMBODIMENTS

With reference to the cited drawing figures, the cover structure for books, diary books, and the like, according to the invention, which is generally designated with the reference numeral 1, comprises, in one body, two cover panels, namely a front cover panel 2 and back cover 3 which are substantially rigid.

The rigid cover panels 2 and 3 are joined together by an outside spine 4 of a substantially flexible material forming an integral part of the cover panels 2 and 3.

According to a preferred embodiment, but not limited thereto, the two different characteristics, that is stiffness of the panels and flexibility of the spine, are achieved by particular techniques of molding from commercially readilly available plastics materials, such as those sold under the trademark ELVAX, manufactured by E. I. Dupont de Nemours.

More specifically, the spine has a much reduced thickness which can thus impart to the spine high characteristics of flexibility and elasticity, while giving assurance of being immune from problems of distortion and wear resulting from the cover opening and closing. It will be understood thus that for the molding operation the shape of the inner space defined by the mold halves is adjusted so that the thickness of the spine portion is about five times smaller than the thickness of the cover portions. Preferred thickness values are in the range of 0.3 to 0.6 mm for the spine portion and 2 to 3 mm for the cover portions.

Directly applicable as by glueing on the inside face of the spine 4, that is with the interposition of an adhesive or cementing layer 5, are a stack of sheets or pamphlets, indicated at 10, which practically form the diary book.

Advantageously, in order to provide the cover panels 2 and 3 with the desired rigidity features, there are provided peripheral edge trims 11 which span the whole periphery of the cover panels, as well as folds 12 which, in addition to providing a decorative pattern, also form in practice a cover panel stiffening element.

It will be appreciated from the foregoing that the cover of this invention combines the advantages afforded by the two currently more commonly used book-binding techniques, that is, an integral cover structure has been provided which has two rigid panels and a highly flexible outside spine which is glued directly to the inside spine edge or back of the stack of sheets or pamphlets, thus ensuring that no problems or risks of separation at the connection area between the cover panels and stack of sheets or pamphlets are encountered, as is instead the case with prior diary books provided with rigid cover panels but having their spines not directly attached by glueing to the spine edge or back of the stack of sheets or pamphlets.

Thus, according to the invention, a cover structure, has been provided which is a single-piece construction from a plastics material and allows a significant simplification of all the binding steps of the diary book or book or the like, to result in a product of high quality characteristics.

While in the embodiment shown in FIGS. 1–3 a single moldable starting polymeric material has been used both for the cover and the spine portions, it has been found that it is possible to select different plastics materials suitable to be welded together by the ultrasonic welding techniques in such a manner that the so united plastics materials may be considered as if they were integral parts of each other i.e. as a single piece.

In the embodiment shown in FIGS. 4,5 and 6 in which like component parts are indicated with the same reference numerals, the spine portion 4*a* is made initially of a separate flexible band of plastics material, which is made integral with the covers 2 and 3 and the anchoring ledges 2*a* and 3*b* by means of ultrasonic welding so that in the finished conditions the spine 4*a* may be considered as an integral part of the covers 2 and 3 as if they were made as a single piece portion with different rigidity and flexibility characteristics. In order to facilitate that the spine portion 4*a* becomes an integral part of the cover portions 2, 3 the band forming the spine 4*a* is provided with longitudinal beads 4*b* at the longitudinal edges of the band 4*a*. The beads 4*b* are received in longitudinal grooves 2*c* and 3*c* provided in the covers 2 and 3. For the same purpose the rims 2*d*, 3*d* facing each other are bent Z-like and the anchoring ledges 2*a* and 3*b* have a shape complemental thereto. In addition the covers 2 and 3 are provided near their rims 2*d* and 3*d* with stud formations 2*f*,3*f* engaging in corresponding openings provided in the spine forming band 4*a*. Likewise, on the upper surface of the rims 2*d* and 3*d* elongated bosses 30 are provided in which elongated aperture 31 provided in the spine forming band 4*a* are engaged. In this embodiment the material used for the spine forming band 4*a* is the one known under the commercial name ELVAX 350 manufactured by Dupont having a thickness of 0.4 mm. The material used for the covers is instead the one identified by the commercial name EDISTIR RF manufactured and sold by Montepolimeri, an affiliate of Montedison S.p.A. of Milan (Italy). The thicknes selected for the covers was 2 mm. Upon ultrasonic welding the materials integrally joined together as if they were made of a single piece.

In practicing the invention, the plastics materials used, as well as the dimensions and contingent shapes, may be any suitable ones to meet individual requirements.

I claim:

1. A cover structure for books, diary books, and the like, of the type including sheets having an inside spine edge, the structure comprising two substantially rigid covers, ledges, and a substantially flexible outside spine, having an inside face and connection portions said covers including contiguous rim portions and having grooves provided therein, said contiguous rim portions being co-extensive with said ledges, said covers being united together by said substantially flexible outside spine, said inside face, of said substantially flexible outside spine being directly attachable to said inside spine edge of said sheets, said connection portions being integral with said substantially flexible outside spine and with said substantially rigid covers, said substantially flexible outside spine comprising a band, said band having longitudinal end portions, said longitudinal end portions being adapted to be clamped between said contiguous rim portions of said covers and said ledges, said contiguous rim portions and said ledges being Z-like shaped in cross-section, said longitudinal end portions having bead formations, said bead formations being adapted for engagement with said grooves provided in said covers, said contiguous rim portions of said covers having stud and boss formations, said stud and boss formations being adapted for engagement with said band.

* * * * *